US005818396A

United States Patent [19]

Anderson et al.

[11] Patent Number: 5,818,396

[45] Date of Patent: Oct. 6, 1998

[54] LAUNCHER FOR PLURAL BAND FEED SYSTEM

[75] Inventors: Bryant Ford Anderson, Sandy; Charles Andrew Deneris, Bountiful; Kevin L. Teuscher; Paul Johann Gartside, both of Kaysville; Douglas Melville Harrison, Salt Lake City, all of Utah

[73] Assignee: L-3 Communications Corporation, New York, N.Y.

[21] Appl. No.: 698,322

[22] Filed: Aug. 14, 1996

[51] Int. Cl.[6] ..... H01Q 13/00

[52] U.S. Cl. ..... 343/786; 343/785; 343/772; 333/126

[58] Field of Search ..... 343/766, 772, 343/776, 785, 786; 333/21 A, 106, 108, 126, 135

[56] References Cited

U.S. PATENT DOCUMENTS

| | | | |
|---|---|---|---|
| 3,216,017 | 11/1965 | Moore | 343/756 |
| 3,268,902 | 8/1966 | Turrin | 343/786 |
| 3,605,101 | 9/1971 | Kolettis et al. | 343/743 |
| 4,994,818 | 2/1991 | Keilmann | 343/783 |
| 5,005,023 | 4/1991 | Harris | 343/776 |
| 5,017,937 | 5/1991 | Newham et al. | 343/786 |
| 5,109,232 | 4/1992 | Monte | 333/126 |
| 5,122,810 | 6/1992 | Nisbet et al. | 343/756 |
| 5,248,987 | 9/1993 | Lee | 343/786 |
| 5,550,553 | 8/1996 | Yamaki et al. | 343/785 |
| 5,583,469 | 12/1996 | Weinstein et al. | 333/106 |
| 5,635,944 | 6/1997 | Weinstein et al. | 343/776 |

*Primary Examiner*—Donald T. Hajec
*Assistant Examiner*—Tan Ho
*Attorney, Agent, or Firm*—Perman & Green, LLP

[57] ABSTRACT

A feed system for an antenna has a set of inner and outer coaxial waveguides which apply, respectively, both higher and lower frequency radiations to a common radiating aperture provided by a horn and shroud which envelops radiating apertures of the individual feed waveguides. Each of the feed waveguides carries signals having a bandwidth of an octave. Lower frequency radiation to be transmitted by the outer coaxial feed waveguide is applied thereto by a set of four waveguides of a launcher which launches a wave with a desired propagation mode into the outer feed waveguide. Each of the launch waveguides is initially a rectangular double-ridged waveguide for increase bandwidth. The ridging is reduced to a condition of no ridging in the outer feed waveguide by a transition to a single inner ridge which terminates in a tapered star-shaped combination ridge within the outer feed waveguide. Impedance matching rings are slidable within the space between the inner and outer surfaces of the coaxial waveguide for development of a desired standing wave ratio for accurate generation of a desired beam pattern. A dielectric rod is disposed in a forward end of the tube of the inner feed waveguide and protrudes therefrom into the horn for shaping a beam of the higher frequency radiation. A single common phase center is provided for all bands with radiation simultaneously at plural bands.

11 Claims, 12 Drawing Sheets

LAUNCHER FOR PLURAL BAND FEED SYSTEM

BACKGROUND OF THE INVENTION

This invention relates to a feed system for an antenna and, more particularly, to a composite feed covering two octaves of bandwidth and providing a common phase center for radiations in each of a plurality of signal bands radiated by the feed.

Various communication systems employ more than one frequency band for electromagnetic signals radiated from a transmitting station to receiving station. An important example of such a communication system is a satellite communication system wherein various bands of signals are transmitted between a satellite above the earth (synchronous orbit) and ground stations on the earth. Three such bands of interest herein, including C band, X band, and Ku band, extend in total two octaves of the communication frequency spectrum. Within each of the bands, there is frequency space allocated for reception of signals at the satellite and for transmission of signals from the satellite. The C band itself extends over approximately an octave, operates at both linear and circular polarizations, and includes a receive sub-band in the range of 3.625–4.200 GHz and a transmit sub-band in the range of 5.850–6.425 GHz. The X band includes a receive sub-band in the range of 7.250–7.750 GHz (gigahertz), and a transmit sub-band for transmission from the satellite in the range of 7.900–8.400 GHz. The Ku band operates at both linear and circular polarizations, and includes a receive sub-band from 10.950 to 12.750 GHz, and a transmit sub-band of 14.000–14.500 GHz. Collectively, these frequency bands extend over approximately two octaves of the communications spectrum.

Historically, it has been the practice to provide separate antennas for transmission or reception on each of the bands because there is insufficient bandwidth on any one of the antenna systems or terminals to transmit more than one of the bands. In some cases, where bands are close together and, collectively, do not occupy an excessive amount of spectral space, it has been possible to share a plurality of bands on one antenna. However, basically, separate antennas have been employed for different portions of the spectrum. In particular, there is no adequate single-point antenna feed system which can cover plural octave bandwidths which includes C, X and Ku bands.

A problem arises in the case of satellite communication transportable earth stations in that there is a need for minimization of transportable payload weight. The use of numerous antennas for communication at various frequency bands defeats the purpose of minimization of payload weight. In addition, it is advantageous to employ a common phase center for all radiations transmitted from the earth station and received at the earth station. There is no common phase center in the situation wherein several antenna feeds are mounted at different times upon an earth terminal. It has been necessary to change the feed system for each frequency band and to refocus the feed, this requiring time and trained personnel. The same problem exists for an earth terminal at a fixed location because it is still necessary to perform the difficult and tedious process of exchanging feeds and refocusing.

The foregoing problem is compounded by the foregoing spectral utilization. The C band and the Ku band are commercial satellite bands which are spaced apart in the spectrum and, therefore, facilitate the filtering of signals in the two bands so as to permit transmission on one band without significant interference with signals on the other band. However, in the present situation, there is also need to employ the X band which is a military band in conjunction with the C band. In the present situation, it is contemplated that either one of the Ku and the X bands may be employed with the C band or, possibly, that both the Ku and the X bands may be employed concurrently with the C band. However, due to the fact that the X band is contiguous to the C band, it is difficult to separate the two bands in a common antenna system and, furthermore, presently available antenna and feed structures are unable to accomplish this task adequately.

SUMMARY OF THE INVENTION

The aforementioned problems are overcome and other advantages are provided by an antenna feed system which, in accordance with the invention, has a composite coaxial feed structure with plural signal input ports for transmission at each of a plurality of frequency bands via a common single point feed with a horn, shroud and tube arrangement which produces a common phase center. With reference to the foregoing listing of the frequency bands of interest, the Ku band and the X band signals are transmitted via a central circular waveguide constructed of a metallic electrically conducting tube and located coaxially to a central axis of the feed. The C band signals are transmitted via coaxial waveguides comprising a center waveguide tube as inner conductor, and an outer tubular conductor coaxial to and spaced apart from the inner conductor. Radiating openings of the circular waveguide and of the outer coaxial waveguide are located within a common aperture and, together with the horn, constitute the feed assembly. For ease of reference, the center circular waveguide may be referred to as the inner feed waveguide, and the outer coaxial waveguide may be referred to as the outer feed waveguide. Preferably, the feed is employed to illuminate a reflector or subreflector of the antenna for establishing a desired beam pattern; however, the feed may be used without a reflector for directly radiating a beam of radiation. The feed may also be used with an off-set reflector assembly.

An aspect of the invention which is of particular interest herein is the launching of hybrid mode from a radiating aperture of the outer feed waveguide, this mode being a combination of the $TE_{11}$ and the $TM_{11}$ modes. In order to generate these modes, it is necessary to excite the outer feed waveguide uniformly with symmetry about a longitudinal axis of the waveguide. This is accomplished by the invention by an array of launch waveguides fanning into the the outer feed waveguide. There is an even number of the launch waveguides, and radially opposite pairs of launch waveguides are operable independently of other pairs of launch waveguides, as will be described below. The launch waveguides have ridges to lock in a specific polarization for handling an octave bandwidth.

It is to be understood that the teachings of the invention apply to various combinations of frequency bands occupying in excess of an octave of spectral space such as the aforementioned two octaves of frequency space. For convenience in explaining the invention, reference has been made to the aforementioned set of C, X and Ku bands, it being understood that the invention applies by scaling also to other frequency bands.

With reference to the foregoing set of frequency bands, it is noticed that the X band signals occupy approximately one-half octave, and that the Ku band signals also occupy one-half octave. Their combined spectral space is approximately one octave. In contrast, the C band signals themselves occupy one octave. Accordingly, each of the feed waveguides is allocated one octave of frequency space. This is accomplished by the foregoing assignment of the signal bandwidths wherein the inner feed waveguide carries the X and the Ku band signals, and the outer feed waveguide carries the C band signals.

In a typical situation of use of the invention, either the commercial Ku band or the military X band would be employed. In such case, it is not necessary to couple both of the X and the Ku band signals to the feed system. However, the feed system is operative to provide simultaneous beams of X and C band radiation. Coupling of X band and Ku band signals to the inner feed waveguide may be accomplished by a switch when it is desired to utilize either the X band or the Ku band signals. Alternatively, the X and the Ku bands may be operated simultaneously with a coupling device instead of a switch. The C band signals are fed to the outer feed waveguide in a symmetrical pattern about the central axis by use of four waveguides distributed uniformly about the central axis and being inclined relative to the central axis. The four waveguides serve to launch a C band wave in a desired mode of propagation for radiation from the feed horn in conjunction with the radiations of the X and the Ku bands of radiation. For ease of reference, the assembly of the four waveguides may be referred to as a launcher, and each of the four waveguides may be referred to as a launch waveguide.

An envelope of the configuration of the four waveguides, and of the launcher, has the shape of a cone. At the base of the cone, each of the launch waveguides has a cross section which is essentially rectangular, having two broad walls connected by narrower sidewalls. The sidewalls are nearly parallel to radii of the cone, and the broad walls are normal to the radii. As the waveguides progress from the base of the cone toward the apex of the cone, the broad walls become curved with increasingly greater curvature. Also, the waveguides become closer with progression toward the apex until, in the region of the apex, the thin walls which separate the launch waveguides terminate and allow the four launch waveguides to merge to form the outer feed waveguide.

In accordance with a feature of the invention, the launch waveguides are adapted to provide an octave bandwidth for transmission of the C band signal. This is accomplished by constructing the launch waveguides with ridges extending inwardly from each of the broad walls. Thus, at the base of the cone, each of the launch waveguides has a double ridged cross section. The ridging also provides the advantage of locking a mode of propagation of the C band signal through each of the launch waveguides. This is important for insuring that the C band waves arriving at the outer feed waveguide have the requisite mode for launching the desired mode of propagation of the wave in the outer feed waveguide.

The ridging is not present in the outer feed waveguide in the vicinity of the radiating aperture and, accordingly, the invention provides for a transition from the double ridging to no ridging. The transition begins at the base region of the launcher and terminates in a region of the outer feed waveguide contiguous to the launcher. The ridge of the outer broad wall of each launch waveguide gradually tapers to zero height at the apex of the launcher, at which point there is only one ridge, namely, the ridge of the inner broad wall. At the base of the launcher, the inner and the outer ridges are of equal height in each of the launch waveguides. Upon progression of a launch waveguide from the base to the apex of the launcher, as the outer ridge decreases in height, the inner ridge increases in height to provide a spacing between the two ridges which decreases to a value, at the apex of the launcher, which is approximately 60–85 percent of the original spacing at the base of the launcher. This leaves, at the junction of the launcher and the outer feed waveguide, a star-shaped array of the four inner ridges with no separating walls.

The four inner ridges of the star are then diminished by a tapering with progression along the outer feed waveguide toward the radiating aperture. The inner ridges disappear completely well before the radiating aperture to allow the desired wave propagation mode to be developed within the outer feed waveguide. In the outer feed waveguide, tuning rings may be slid along the surface of the outer conductor and/or along the surface of the inner conductor to facilitate development of the desired propagation mode with a minimum standing wave ratio, and thereby tune the outer feed waveguide. Other means of tuning may also be employed to minimize the standing wave ratio.

As the outer feed waveguide extends forward towards its radiating aperture, the outer conductor of the outer waveguide feed takes the form of a horn having a circular cylindrical shape, and includes a series of step increases in its diameter. The steps are employed in the forming of the desired wave propagation mode in the horn. The horn is terminated in a shroud having a diameter of approximately 3/2 midband wavelength of the C band radiation, the shroud diameter being larger than the diameter of the outer feed waveguide by a factor of approximately 3/2. The shroud extends forward of the mouth of the outer feed waveguide by approximately one-quarter of the midband wavelength of the C band radiation. The shroud allows the wide band or multi-octave operation and supports the common phase center.

The inner feed waveguide is terminated by a dielectric rod inserted in the mouth of tube of the inner feed waveguide. The diameter of the inner surface of the inner feed waveguide tapers inwardly to a neck having a slight reduction of diameter at the location of contact with the rod. The diameter of the inner feed waveguide is greater than the diameter of the neck by a factor of approximately 4/3. The neck diameter is approximately at the cut-off frequency of the C band radiation, and aids in attenuating such radiation as may enter into the inner feed waveguide and be reflected back out with a resonance that alters the C band phase and beam pattern. The outer surface of the tube of the inner feed waveguide is stepped down in diameter with an encircling reentrant cavity or trough at the location of the rod. This configuration of the outer surface of the tube of the inner feed waveguide aids in control and shaping of the X and Ku band beam patterns.

By way of example, in the preferred embodiment of the invention wherein the inside diameter of the horn at the shroud opening is 3.625 inch, the inside diameter of the tube is 1.07 inch, and the inside diameter of the neck is 0.85 inch, the diameter of the horn is greater than the diameter of the inner feed waveguide by a factor of approximately 4/1. The ratio of the diameters of the inner and the outer conductors of the coaxial waveguides is equal approximately to the ratio of the mid-band wavelength of the C band radiation to the wavelength at the center of the X and the Ku bands carried by the inner feed waveguide. The rod has a dielectric constant of approximately 2, and may be fabricated of a plastic material. The rod decreases the wavelength of radiation propagating within the rod, by virtue of the increase in dielectric constant, and serves to control beam width in concert with the shroud. The rod extends forward of the mouth of the inner feed waveguide, and forward of the horn into the region of the shroud, and is shaped to reduce interaction between the radiations carried by the two feed waveguides. In particular, the rod has a forward cylindrical cavity of cylindrical shape and a larger rear cavity of conic shape.

An aspect of the operation of the feed system, in accordance with the invention, is the deployment of the launch waveguides in opposite launch pairs. It is useful to consider a rear view of the launcher with the central axis being horizontal, it being understood that the feed assembly is operative in any orientation. In the rear view, the four launch waveguides present the arrangement of an top waveguide, a bottom waveguide, a right waveguide and a left waveguide. The top and the bottom waveguides constitute one pair of opposite cooperating launch waveguides, and the right and the left waveguides constitute the second pair of opposite cooperating launch waveguides. In either of the two pairs of waveguides, the transmitted signals have an equal cophasal relationship which is carried forward to the apex of the launcher. At the apex of the launcher, the electric fields are oriented in the vertical direction in both of the top and the bottom waveguides, and the magnetic fields circulate in a common direction about a common vertical axis. The electric fields are oriented in the horizontal direction in both of the left and the right waveguides, and the magnetic fields circulate in a common direction about a common horizontal axis. Thereby, at the star, the magnetic fields of either pair of launch waveguides have the requisite directions for launching a balanced coaxial mode of an RF (radio frequency) wave in the outer feed waveguide. If desired, the signals of both pairs of launch waveguides may be synchronized with a quadrature relationship to produce a circular polarization within the outer feed waveguide.

The following waveguide modes are provided. In each of the launch waveguides, there is a $TE_{11}$ mode. In the outer waveguide feed, there is a $TE_{11}$ coaxial mode wave for each of the opposite pairs of launch waveguides. The operation of the star and other components of the outer feed waveguide are operative to generate the foregoing $TE_{11}$ mode and to inhibit formation of other modes of propagation, such as TEM or $TE_{21}$ coaxial modes. At the forward location of the feed wherein the inner conductor of the coaxial line has terminated, and only the rod is present at the central axis, mode conversions take place with the effect of exciting the circular $TE_{11}$ and $TM_{11}$ modes. A combination of these modes constitutes an $HE_{11}$-like hybrid mode which produces the circular radiation pattern desired for the system.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION

Figure 1:
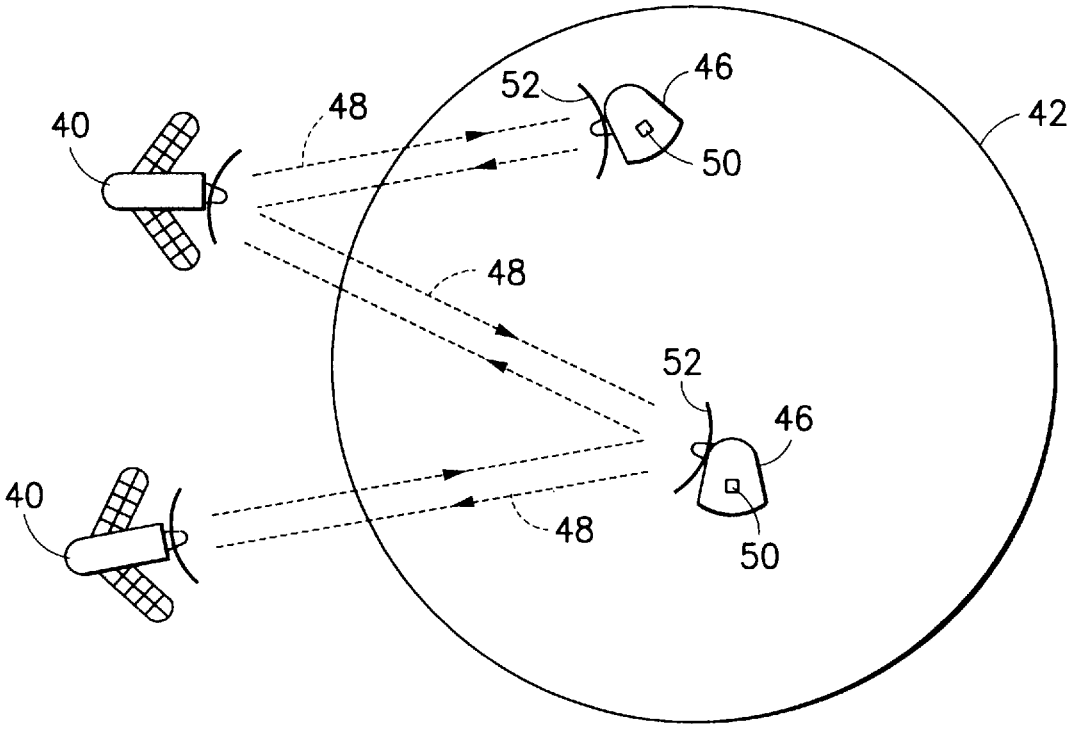
FIG. 1 is a stylized view of satellites above the earth for communication with ground stations.

In FIG. 1, satellites 40 encircle the earth 42 as part of a communication system 44 which includes also ground terminals or stations 46 which may be moving or stationary, two of the satellites and two of the ground stations being shown by way of example. Communication links 48, which include both up-link and down-link communications, are established between the satellites 40 and the ground stations 46. For communication via the links 48, each of the ground stations 46 employ electronic equipment 50 including an antenna 52 which generates beams of radiation at each of the foregoing C, X and Ku bands of radiation for transmission of signals to the satellites 40, and for receiving signals from the satellites 40.

Figure 2:
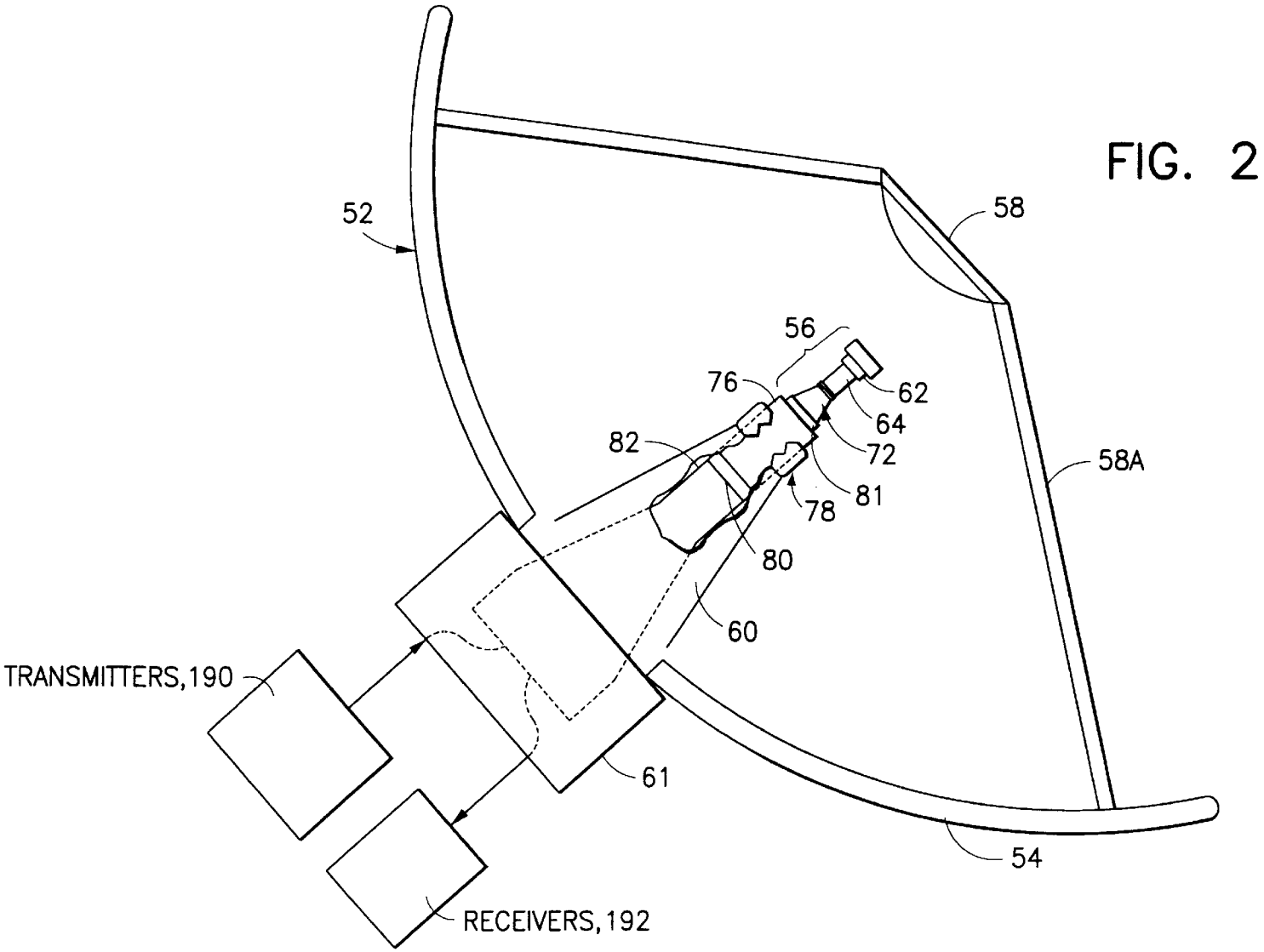
FIG. 2 is a diagrammatic view of a feed system incorporated within each of the ground antenna stations, a portion of the feed being cut away to show the location of a waveguide system of the feed.
Figure 3:
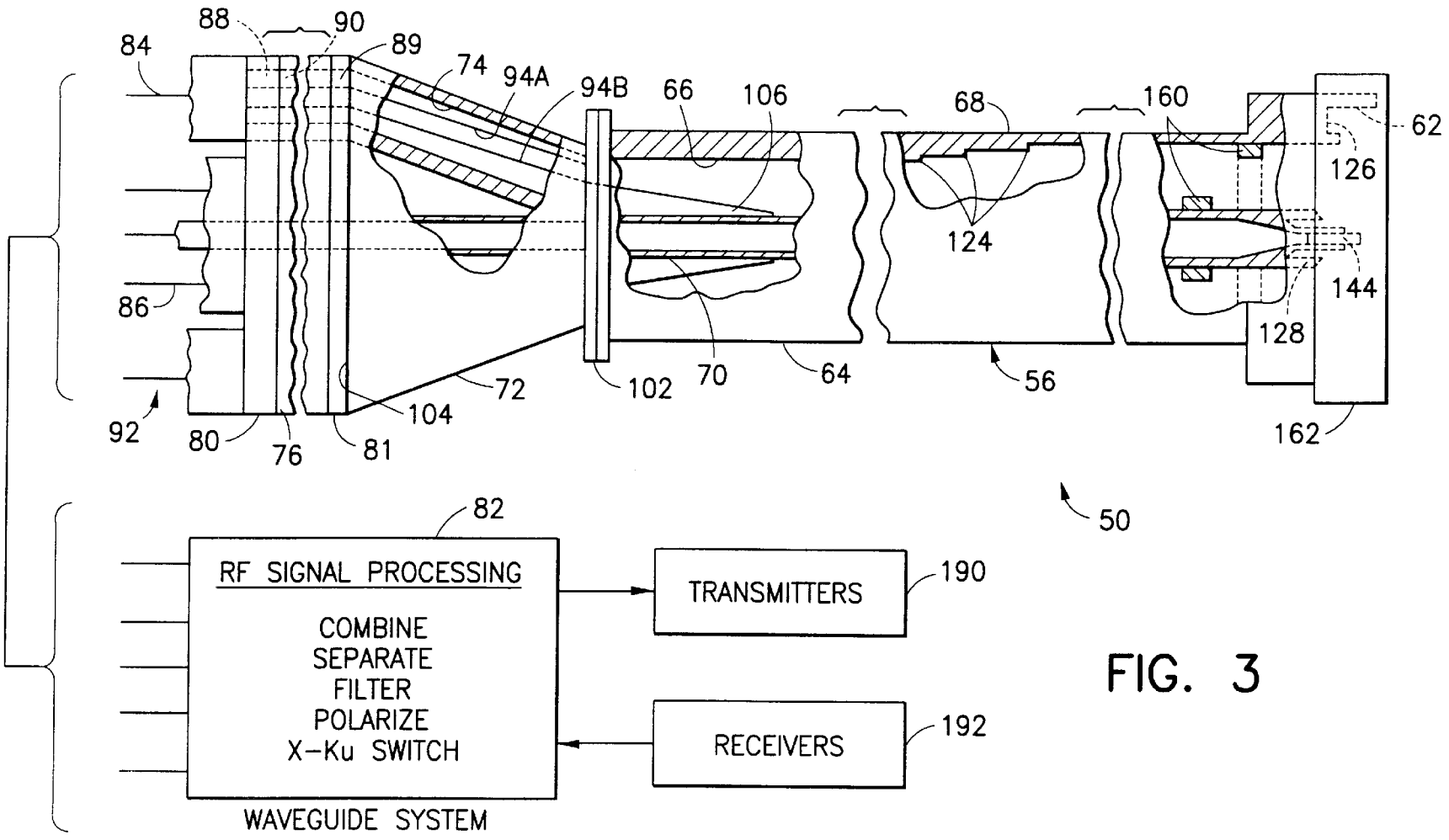
FIG. 3 is a diagrammatic view of a feed of the antenna of FIG. 2, the feed embodying the invention, and the view being partially cut away to show interior portions of the feed.
Figure 4:
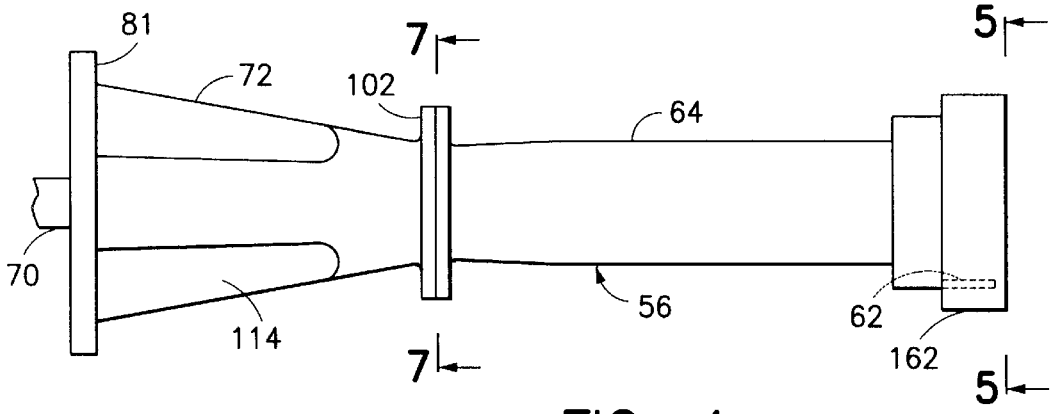
FIG. 4 is a side view of the feed.

As shown in FIG. 2, the antenna 52 comprises a main reflector 54, a feed 56, and a subreflector 58 which serves to direct rays from the feed 56 to the main reflector 54 for generating a transmitted beam of radiation. The subreflector 58 is shown, by way of example, as having a convex generally parabolic surface in the manner of a Cassegrain antenna, it being understood that the invention may be practiced with an alternative configuration (not shown) of subreflector having a concave generally ellipsoidal surface in the manner of a Gregorian antenna. Struts 58A secure the subreflector 58 to the main reflector 54. The antenna 52 operates also in reciprocal fashion to provide a received beam of radiation. To simplify the description, the antenna 52 is described in terms of a transmitted signal, it being understood that the description applies also to a received signal. The antenna 52 includes a cone assembly 60 secured to a hub assembly 61. The hub assembly 61 connects with the main reflector 54, and holds the feed 56 in its position in the antenna 52. In accordance with the invention, and as shown in FIGS. 2 and 3, the feed 56 comprises a shroud 62 at a radiating aperture of the feed 56. The feed 56 further comprises a coaxial waveguide assembly 64 connecting with the shroud 62 and comprising an outer feed waveguide 66 terminating in a horn 68, and an inner feed waveguide in the form of a feed tube 70. The feed 56 also includes a launcher 72 encircling the feed tube 70 and comprising a set of four launch waveguides 74 (one of which is indicated in FIG. 3) for launching electromagnetic waves in the outer feed waveguide 66.

To facilitate connection with the cone assembly 60, the launch waveguides 74 may be extended through a cylindrical holding element having the shape of a piston and, for ease of reference, is referred to as the piston 76. The piston 76 is encircled by a collar 78 of the cone assembly 60 to provide a secure grip of the feed 56 by the cone assembly 60 for positioning the feed 56 relative to the subreflector 58. The piston 76 may be slid within the collar 78 for focusing the transmitted radiation upon the subreflector 58. Mounting plates 80 and 81 are disposed on opposite ends of the piston 76. The mounting plate 80 is on the backside of the piston 76 (shown in a cut-away portion of the cone assembly 60), and is located within the cone assembly 60. The mounting plate 80 secures a waveguide system 82, also within the cone assembly 60, for coupling individual waveguides of the system 82 to respective ones of the launch waveguides 74.

Figure 14:
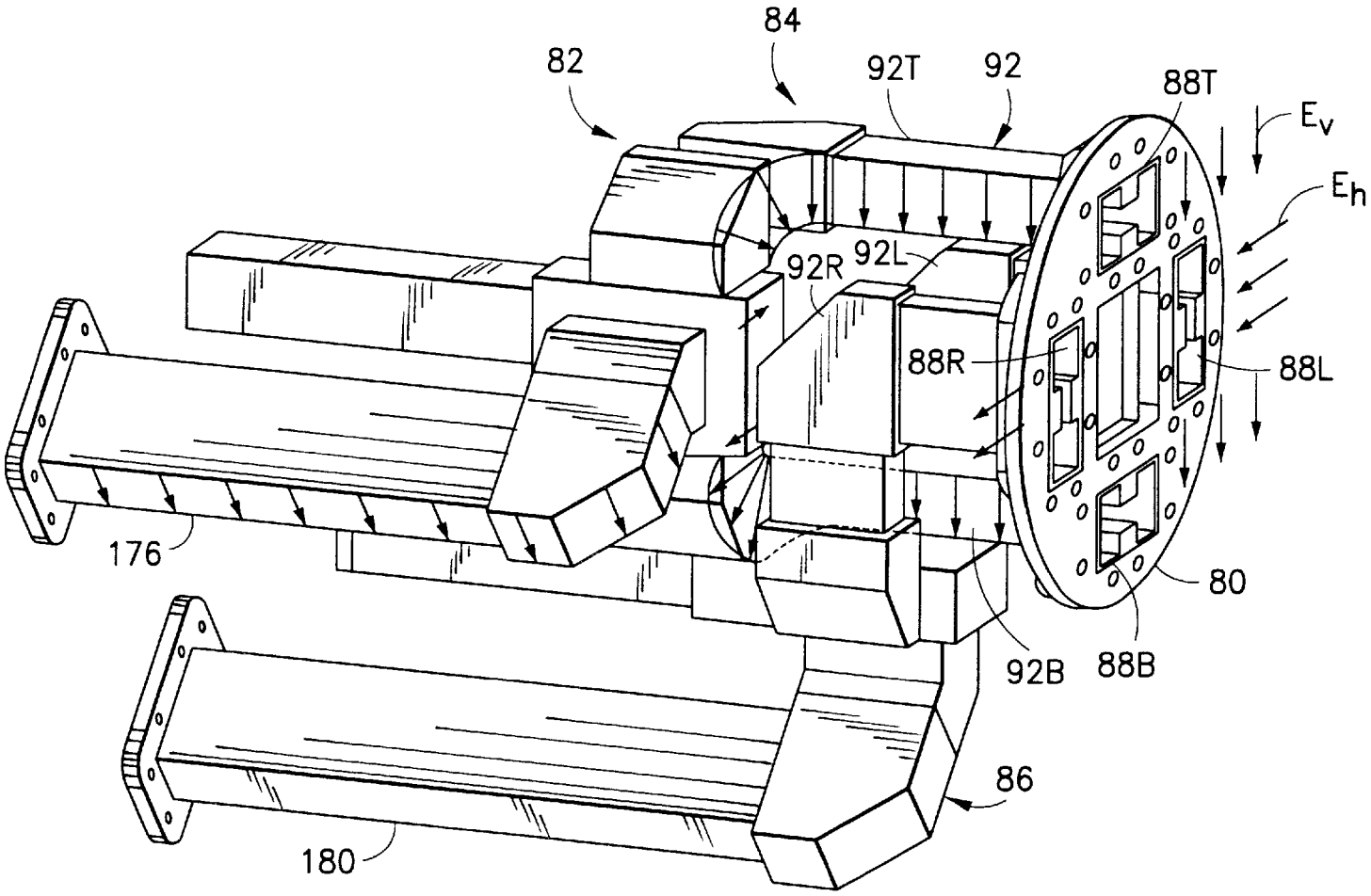
FIG. 14 shows an arrangement of waveguides of a waveguide system making connection with a mounting plate at the rear of the launcher of the feed, the view being a stylized perspective view, the waveguide system providing for power splitting/combining and polarization of RF signals.
Figure 15:
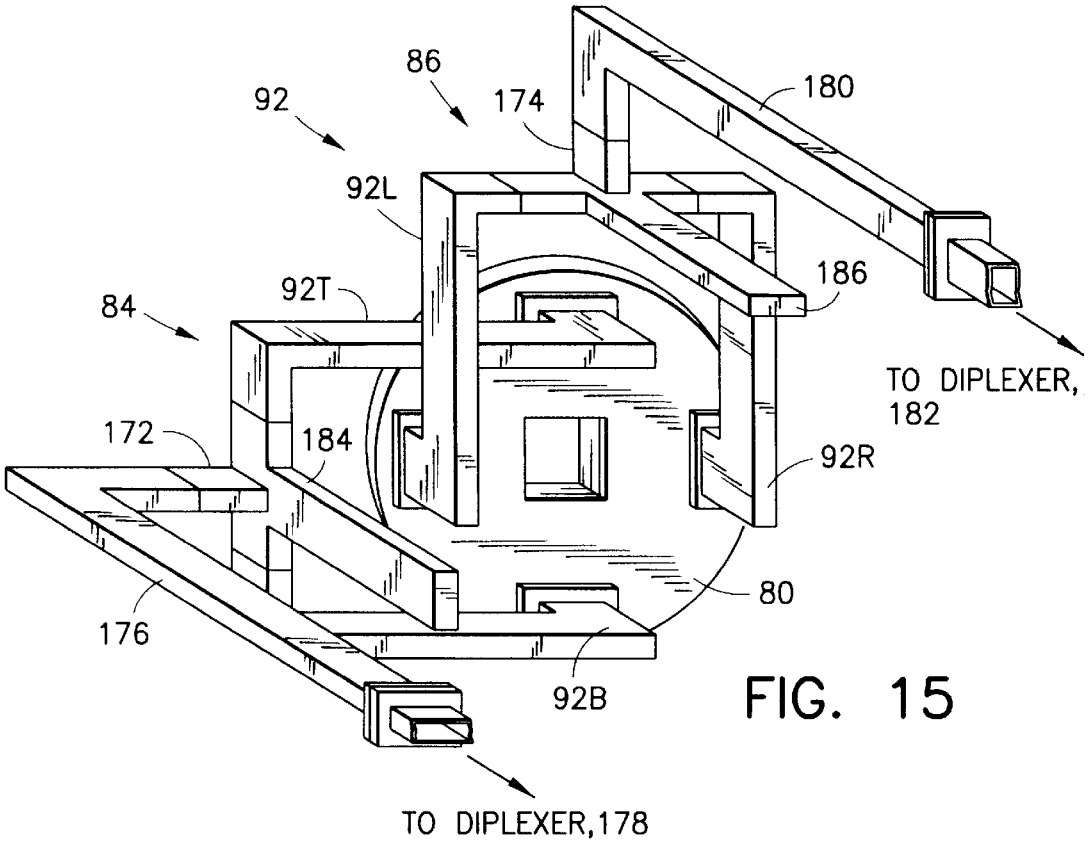
FIG. 15 is a further view of the waveguides of FIG. 14, the view being a simplified diagrammatic view.

The waveguide system 82 energizes the launch waveguides 74 in pairs with as first opposite pair 84 of waveguides of the system 82 energizing the top and the bottom ones of the launch waveguides 74, further identified respectively as waveguides 74T and 74B. A second opposite pair 86 of waveguides of the system 82 energizes a left waveguide 74L and a right waveguide 74R of the launcher 72. Connection of waveguides of the waveguide system 82 to the launch waveguides 74 is made via passages 88 and 89 respectively in the mounting plates 80 and 81, and via passages 90 in the piston 76. The passages 88, 89 and 90 have the same cross sectional configuration. The waveguide assembly 82 comprises numerous waveguides of which a set of waveguides 92 make connection with the mounting plate 80 to provide the foregoing connection to the launch waveguides 74. To facilitate tracing of the paths of flow of electromagnetic power between the waveguide system 82 and the launcher 72, the waveguides 92 are further identified as the top waveguide 92T, the bottom waveguide 92B, the left waveguide 92L and the right waveguide 92R, as shown in FIGS. 14 and 15, in correspondence with the identification of the launch waveguides 74T, 74B, 74L and 74R. Similarly, the passages 88 in the mounting plate 80 are further identified, in corresponding fashion, by the legends 88T, 88B, 88L, and 88R, respectively, for the top, the bottom, the left, and the right ones of the passages 88 as shown in FIG. 14.

For operation of the feed 56, it is important to maintain proper polarization of the RF signals in the various waveguides 74 of the launchers 72 which carry C band radiation to the outer feed waveguide 66 for transmission, and from the outer feed waveguide 66 for reception. A linearly polarized TE wave is present in each of the launch waveguides 74. It is noted that the bandwidth of the C band radiation is approximately one octave and, accordingly, particularly at the shorter wavelengths of the band, it is possible to generate more modes in addition to the primary mode of propagation. In order to maintain integrity of the polarization, and to inhibit formation of the additional modes, each of the launch waveguides 74 is provided with a set of two opposed cooperating ridges 94, best seen in FIG. 6. Each of the launch waveguides 74 has a rectangular cross-sectional configuration, and includes a pair of opposed broad walls 96 joined together by a set of opposed narrower sidewalls 98, typically having a 2:1 ratio. The feed 56, as well as the launcher 72 have symmetry about a longitudinal axis 100. Similarly, the launch waveguides 74 are distributed symmetrically about the axis 100. Radii extending in a plane normal to the axis 100 intercept the broad walls 96 of respective ones of the launch waveguides 74. The broad walls are perpendicular to respective ones of these radii. The ridges 94 are located centrally within respective ones of the broad walls 96 in each of the launch waveguides 74. Thus, an axial plane containing the axis 100 extends through the ridges 94 of the launch waveguides 74T and 74B, and a second axial plane perpendicular to the foregoing axial plane passes through the ridges 94 of the launch waveguides 74L and 74R. It is convenient to identify individual ones of the ridges 94 in each of the waveguides 74 and, accordingly, the ridges are identified as outer ridges 94A and inner ridges 94B, the inner ridges being closer to the axis 100 than the outer ridges 94A.

One of the launch waveguides, namely the waveguide 74T is depicted in FIG. 3 wherein a sidewall of the waveguide has been cut away leaving sectioned broad walls, with a full view of a central region of the ridges 94A and 94B. A feature of the invention is the gradual deletion of the ridges 94 from each of the launch waveguides 74 upon progression in respective ones of the launch waveguide 74 from the mounting plate 80 towards and into the outer feed waveguide 66. This is accomplished by tapering the outer ridge 94A to zero height at a flange assembly 102 at a junction of the launcher 72 and the coaxial waveguide assembly 64. This can be noted best in FIGS. 3 and 10 wherein the outer ridge 94A has full height at a back end surface 104 of the launcher 72, and zero height at the flange assembly 102. As the outer ridge 94A shrinks in height, the inner ridge 94B grows in height to occupy more than half of the distance between the broad walls 96 at the flange assembly 102. Subsequently, with progression of the inner ridge 94B via a star-configured ridge assembly 106 disposed within the outer feed waveguide 66, each of the ridges 94B is tapered gradually to zero height. The ridges of the star-ridge assembly 106 are shown in FIGS. 3, 4 and 8–10. The star-ridge assembly 106 comprises a thin cylinder 108 which serves as a support for the four ridges 94B. The cylinder 108 encircles the feed tube 70, and is in electrical contact therewith. The back end 110 of the star-ridge assembly 106 makes electrical contact with the ridges 94B of the launcher 72. The spacing between the ridges 94A and 94B in each of the launch waveguides 74 varies from a maximum spacing of 0.292 inch at the back end surface 104 of the launcher 72, in a preferred embodiment of the invention, such that a minimum spacing of 0.15 inch occurs at the site of the flange assembly 102. The edges of the ridges 94 may be rounded to inhibit arcing in the case of transmission of high power.

Figure 5:
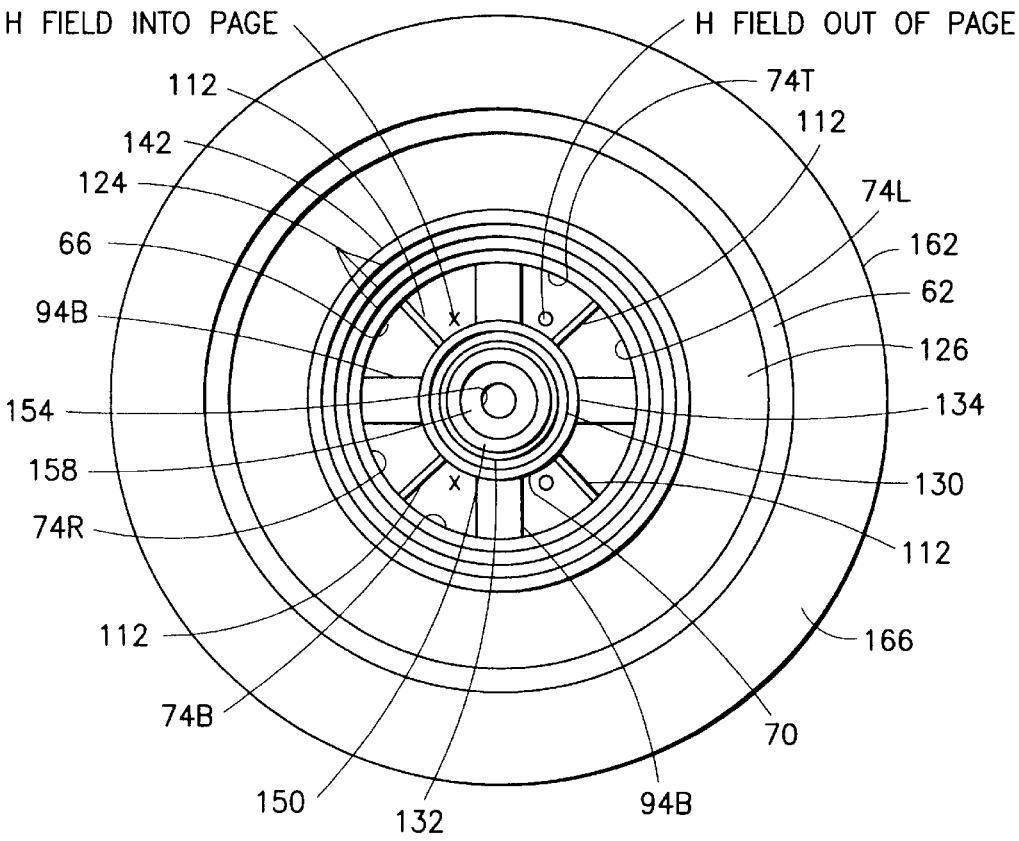
FIG. 5 is a front end view taken along the line 5—5 in FIG. 4 showing internal components of the feed, but without tuning rings to clarify the drawing.
Figure 6:
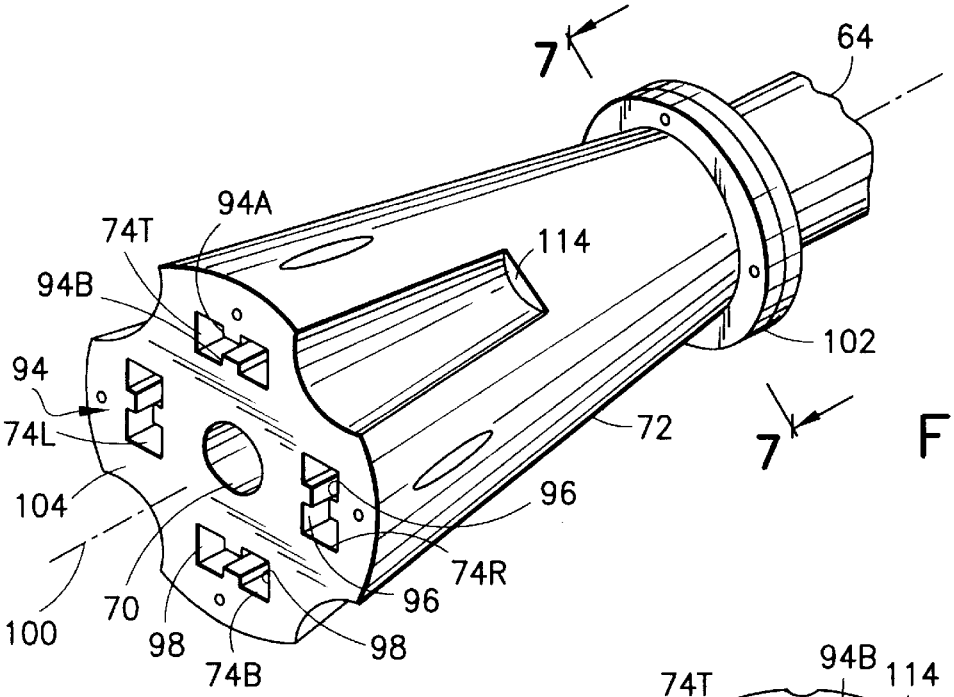
FIG. 6 is a perspective view of a rear portion of the feed showing waveguide sections of a launcher portion of the feed.

There is considerable spacing between consecutive ones of the launch waveguide 74, such as between the launch waveguide 74T and 74R, by way of example, at the back end surface 104 of the launcher 72, as is depicted in FIG. 6. This spacing diminishes with decreasing radius of the launcher 72 until, at the site of the flange assembly 102, the spacing has been reduced to a set of septa 112 (FIGS. 5 and 7) which separate respective ones of the launch waveguides 74. Also, with progression of the launch waveguides 74 from the back end surface 104 of the launcher 72 to the flange assembly 102, the rectangular configuration of each waveguide 74 at the back end surface 104 is gradually changed by introduction of a curvature in the broad walls 96 so as to meet the curvature of the outer feed waveguide 66 at the site of the flange assembly 102. This change in configuration is gradual, and the complete matching of curvature does not occur until the waveguides 74 reach the site of the flange assembly 102. The change in configuration is manifested by the curvature of the broad walls 96, as shown on FIGS. 5 and 7, and also by a reorientation of the sidewalls 98 at the septa 112 wherein the septa 112 are disposed along axial planes, and are directed radially outward from the central axis 100 (shown in FIG. 7).

Figure 7:
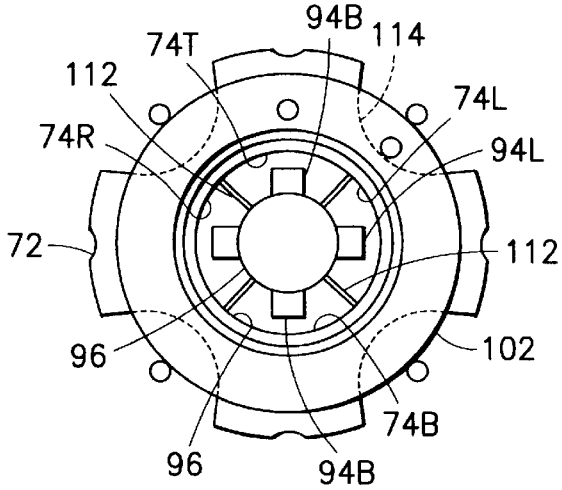
FIG. 7 is a plan view of the launcher portion of the feed showing internal components of the launcher lying along a transverse plane indicated by the line 7—7 on FIGS. 4 and 6.
Figure 8:
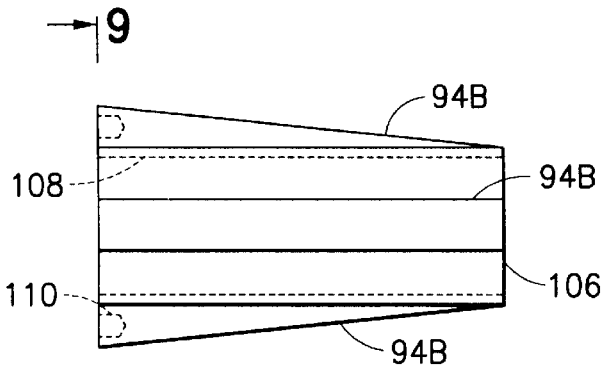
FIG. 8 is a side view of a star assembly of ridges located in front of the launcher, as shown in FIG. 3.
Figure 9:
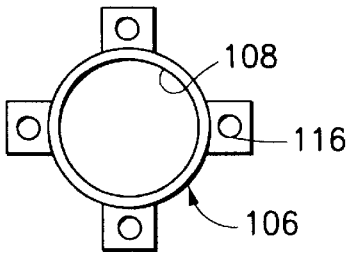
FIG. 9 is a rear view of the star assembly assembly taken along the line 9—9 in FIG. 8.

Accordingly, FIG. 7, which depicts only the arrangement of components located in the transverse plane of the flange assembly 102, shows the arcuate cross-sectional configuration of each of the launch waveguides 74, and also shows the radially extending height of each of the ridges 94B. In contradistinction, with reference to the view of FIG. 5, the ridges 74B are shown extending towards the rear of the feed 56 and with increasing radial distance from the central axis 100. Also shown in FIGS. 6 and 7 are cut-away portions 114 of the housing of the launcher 72 which facilitate access to dowel pins and bolts employed for assembling the various parts of the feed 56. By way of further example in the assembly of the feed 56, FIGS. 8–10 show the use of dowel pins at 116 used for aligning the star-ridge assembly 106 with the launcher 72.

Figure 10:
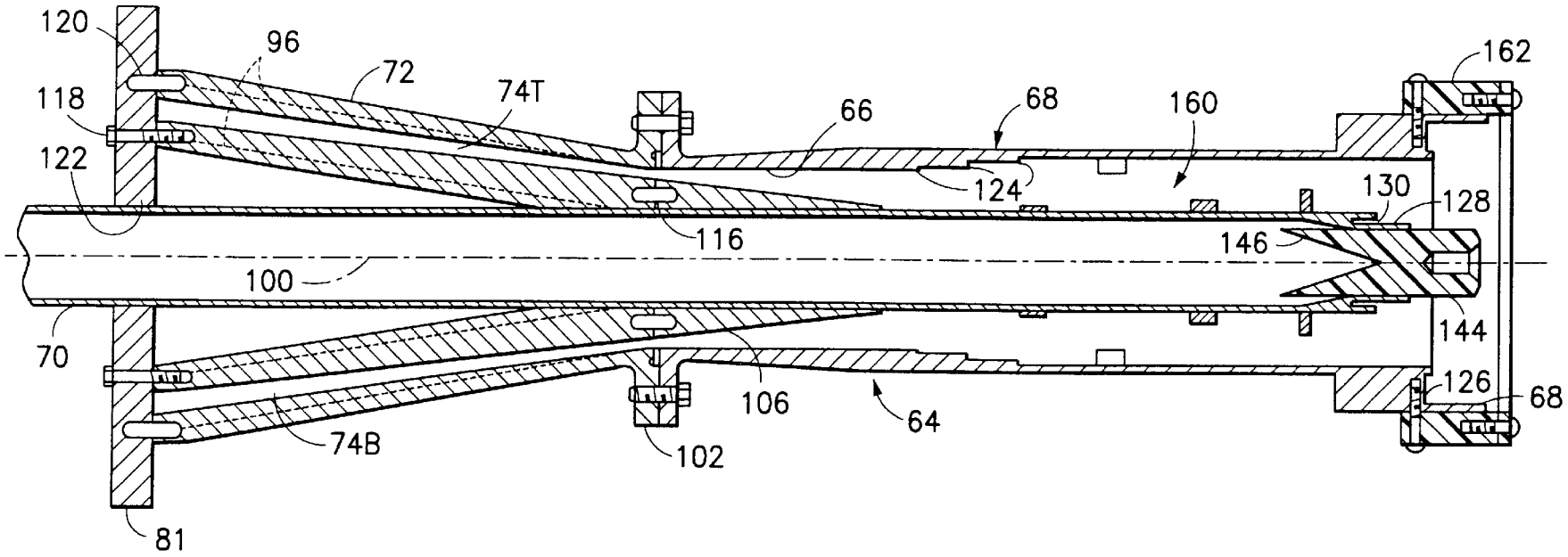
FIG. 10 is an axial sectional view of the feed.
Figure 11:
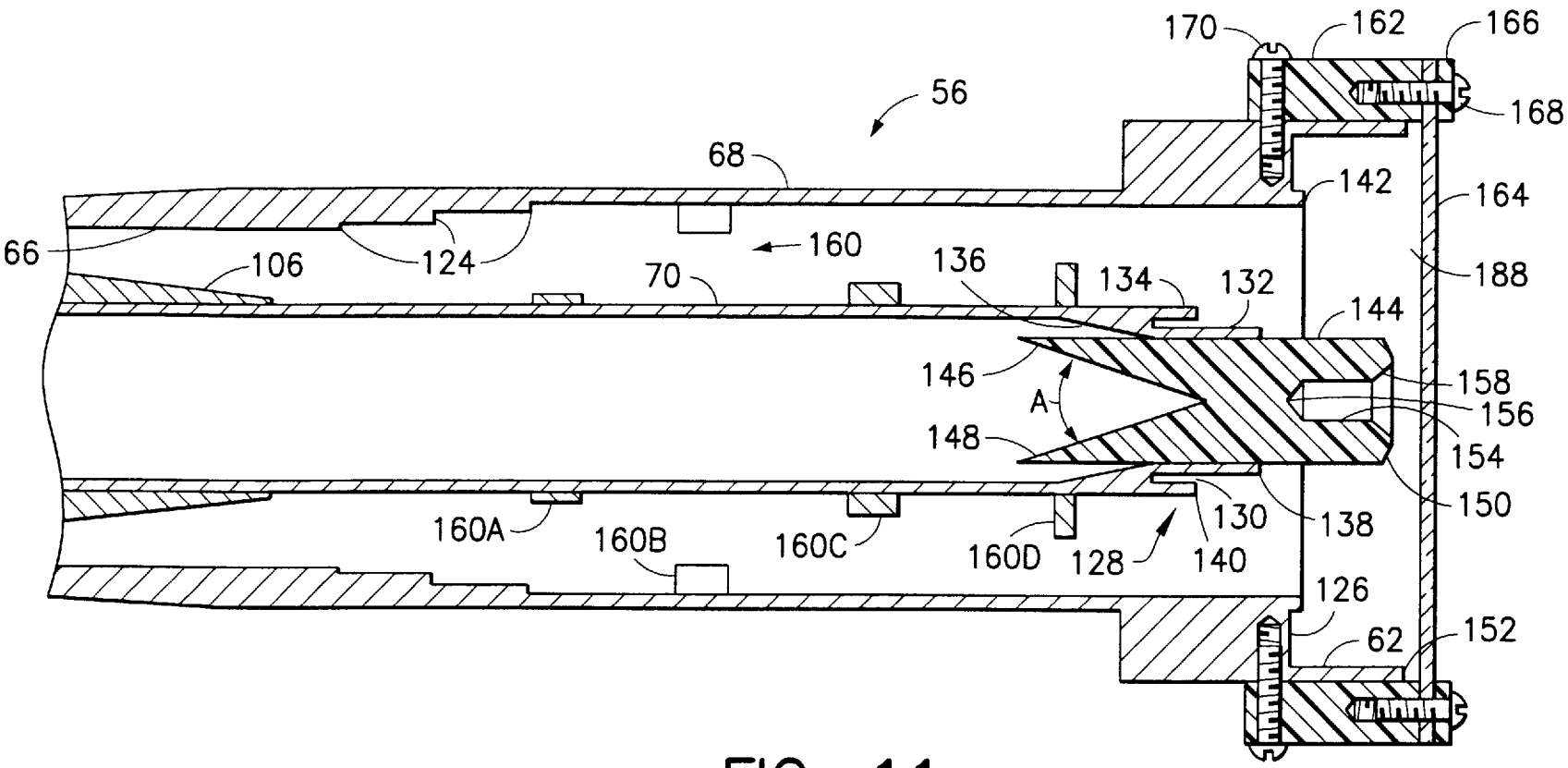
FIG. 11 is an enlarged view of a front portion of the feed of FIG. 10.

With reference to FIGS. 10 and 11, the feed tube 70 extends along the axis 100 and contacts the launcher assembly 72 at the forward end region of the launcher 72 contiguous the flange assembly 102. The mounting plate 80 is secured by bolts 118 and dowel pins 120 to the back end surface 104 of the launcher 72. The center of the mounting plate 80 has a bore 122 for receiving the feed tube 70, and for positioning the feed tube 70 relative to the launcher 72. The flange assembly 102 secures the outer feed waveguide 66 to the launcher 72, and maintains the relative positions between the outer feed waveguide 66 and the inner feed waveguide provided by the tube 70. The outer and the inner feed waveguides provide the coaxial configuration of feed waveguides of the coaxial waveguide assembly 64.

The outer waveguide 66 proceeds forward to the horn 68 by a series of impedance matching steps 124 to the larger inside diameter of the horn 68. At the forward end of the horn 68, the shroud 62 extends still further forward with a diameter significantly larger than the diameter of the horn 68. The increase in diameter of the shroud 62 is accomplished with the aid of a shallow reentrant cavity 126, and with a neck 128 at the forward end of the feed tube 70. The diameter of the neck 128 is less than the diameter of the feed tube 70. The reduction in diameter is accomplished with the aid of a deep reentrant cavity 130 wherein the inner wall 132 extends forward of the outer wall 134. On the interior of the feed tube 70 there is a transition 136, having an inclined wall, to meet the reduced diameter of the inner wall 132 of the neck 128. The front end 138 of the inner wall 132 is located at a site approximately midway between the front end 140 of the outer wall 134 and a lip 142 of the shallow reentrant cavity 126. The bottom of the shallow reentrant cavity 126 is flat and extends along a plane normal to the central axis 100.

Disposed within the neck 128 is a rod 144 of dielectric material. The outer surface of the rod 144 is a right circular cylinder. The back end of the rod 144 is provided with a V-shaped cavity 146 having an entrance angle A of approximately 32 degrees. A lip 148 of the cavity 146 extends to a point slightly behind the transition 136. The deepest point of the cavity 146 is located at a point midway between the front ends 138 and 140, respectively, of the inner wall 132 and the outer wall 134. The forward end 150 of the rod 144 extends forward of the neck 128 to a location approximately equal to the location of the lip 152 of the shroud 62. The forward end 150 includes a forward cavity 154 having a cylindrical surface extending inward along the central axis 100. A floor 156 of the forward cavity 154 is tapered and, also, the a edge 158 of the forward cavity 154 is tapered. The reasons for the configuration of the rod 154, as well as for the construction of the neck 128 and of the shroud 62, will be explained below.

To facilitate tuning and mode matching, it is useful to employ tuning rings 160, four of which are shown by way of example. The tuning rings 160 have differing shapes and sizes, and are identified as rings 160A, 160B, 160C, and 160D. The rings 160A, 160C, and 160D slide along the feed tube 70, and the tuning ring 160B is of larger diameter to slide along the interior surface of the horn 60. The tuning rings 160 serve to preserve the desired modes of electromagnetic waves propagating within the outer feed waveguide 66 towards the shroud 62 as well as to match impedance to reduce any standing wave ratio. A sleeve 162 of dielectric material encircles the shroud 62 and serves as a base for securing a window 164 to the front of the feed 56. A ring 166 of the same dielectric material, as is employed in the sleeve 162, is secured by dielectric screws 168 (preferably of Nylon) to the sleeve 162. The ring 166 clamps the window 164 to the sleeve 162. The sleeve 162 is, in turn, secured to a base portion of the shroud 62 by screws 170. In order to be transparent to the radiation, the window 164 is made of an radio-frequency transparent plastic such as Kapton. The use of the plastic material in the construction of the sleeve 162 avoids a disturbance of the radiation pattern as established by the shroud 62.

Figure 12:
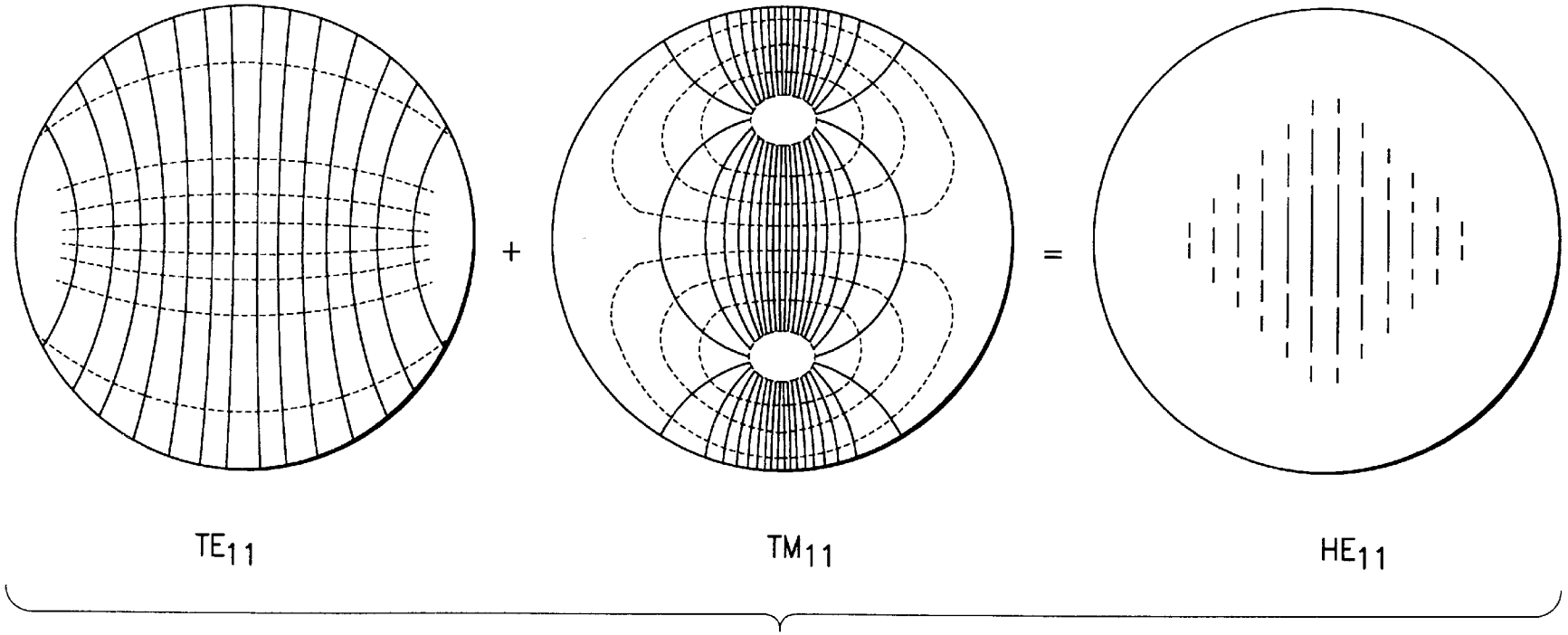
FIG. 12 shows combination of a $TE_{11}$, and a $TM_{11}$, mode to obtain hybrid mode $HE_{11}$ at a radiating aperture of the feed.
Figure 13:
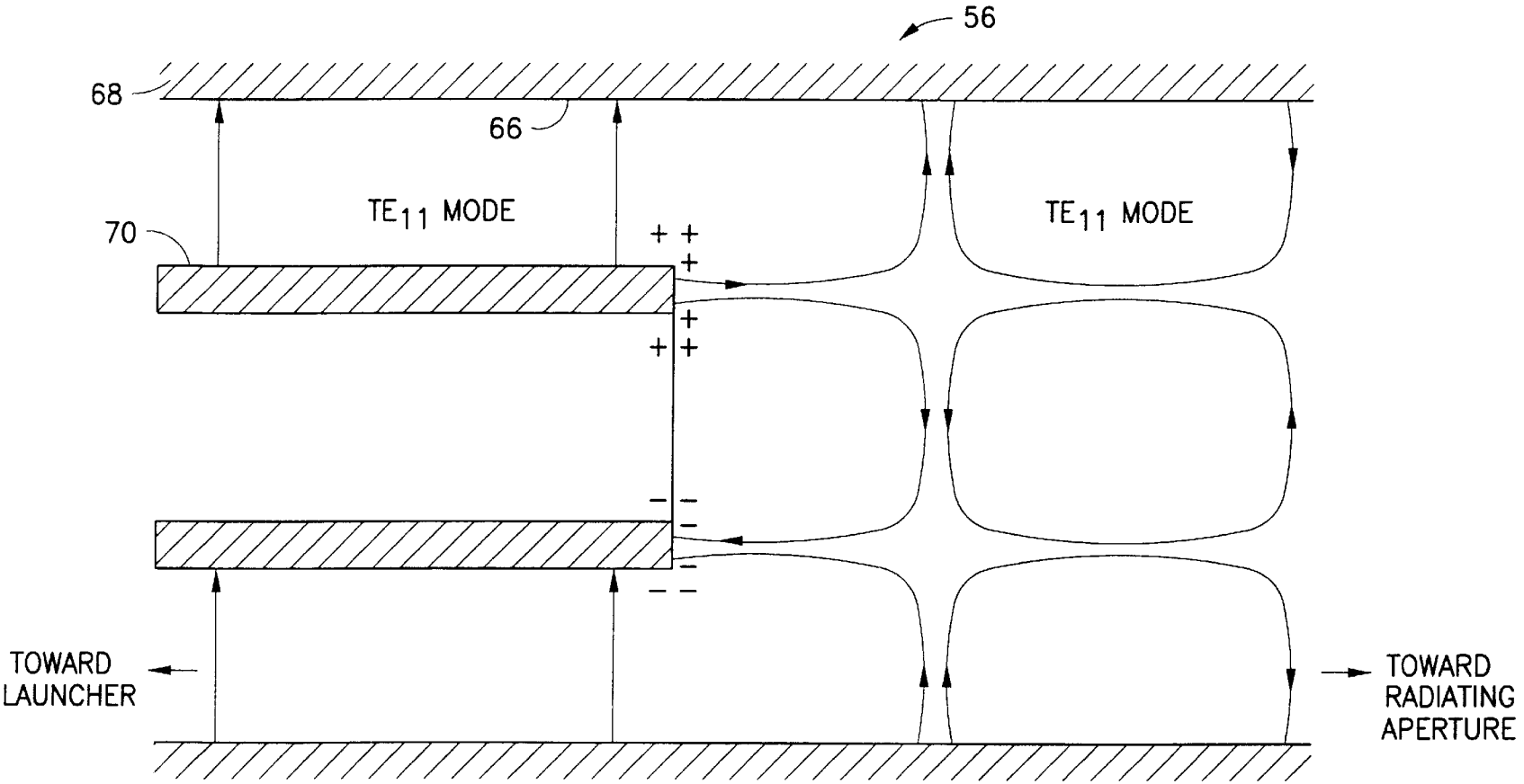
FIG. 13 shows diagrammatically operation of the front portion of the feed to produce the hybrid mode of FIG. 12.

With reference to FIGS. 12 and 13, there is shown the operation of two modes of propagating radiation, namely, the $TE_{11}$, mode, and the $TM_{11}$ mode which sum together to give the hybrid mode $HE_{11}$ mode. FIG. 13 is a simplified view of the front end of the tube 70 of FIG. 11, the view in FIG. 13 being simplified to delete the neck 128 and the rod 144 of FIG. 11. As shown in FIG. 13, in the outer feed waveguide 66, formed by the coaxial arrangement of the outer tube of the horn 68 and the inner feed tube 70, the $TE_{11}$ mode has been excited by the launcher 72 and propagates toward the radiating aperture of the feed 56. The terminating of the inner feed tube 70 introduces also the $TM_{11}$ mode. Thus, in the vicinity of the shroud 62 (FIG. 11), both of the modes are present to produce the hybrid $HE_{11}$ mode.

In the construction of the launcher 72, it is best to minimize, and possibly avoid the number of seams present along the transmission path via the launch waveguides 74 and the star ridge assembly 106 so as to provide, as nearly as possible, a continuous seamless transmission path, thereby to avoid generation of spurious modes. This has been accomplished in the preferred embodiment by construction of the ridges of only two separate components, namely, the launcher 72 and the star ridge assembly 106. As a result, there is only one seam at the flange assembly 102. Similarly, the construction of the shroud 62 and the coaxial waveguide assembly 64 as one unitary structure has avoided the presence of a seam so as to provide for the seamless transmission path.

FIGS. 14 and 15 show an arrangement of the waveguides 92 which connect the mounting plate 80 to the launcher 72

(FIG. 4) for introducing the desired propagating modes into the launch waveguides 74 to enable the launcher 72 to launch the foregoing $TE_{11}$ mode in the outer feed waveguide 66 of FIGS. 10 and 11. As shown in FIG. 14, there are vertically polarized waves propagating in the waveguides 92T and 92B of the first opposite pair 84. These waves have a $TE_{10}$ mode with the electric field being directed primarily between the ridges 94A and 94B, and in a generally vertical direction with reference to FIG. 14. In similar fashion, the waveguides 92L and 92R of the second opposite pair 86 produce, with reference to FIG. 14, horizontally directed electric fields, Eh, these being normal to the vertical, electrical fields Ev. These two fields propagate as orthogonal fields through the waveguides 74 of the launcher 72 to produce the aforementioned circular $TE_{11}$ mode in the outer feed waveguide 66 (FIGS. 3 and 10). The combination of the fields of the launch waveguides 74T and 74B to provide, by themselves, a single TE mode may be explained with reference to FIG. 5 wherein x and o have been placed in each of the waveguides 74T and 74B. The o represents the head of a vector directed out of the plane of the page of the drawing, while the x represents the tail of a vector heading into the plane of the sheet of the drawing. The two sets of vectors combine to produce magnetic fields which circulate around the corresponding electric fields as is characteristic of a circular TE mode. Similar reasoning applies to the rectangular TE modes of the launch waveguides 74L and and 74R to produce a second circular TE mode orthogonal to the first circular TE mode. This results in the aforementioned circular $TE_{11}$ mode.

Figure 16:
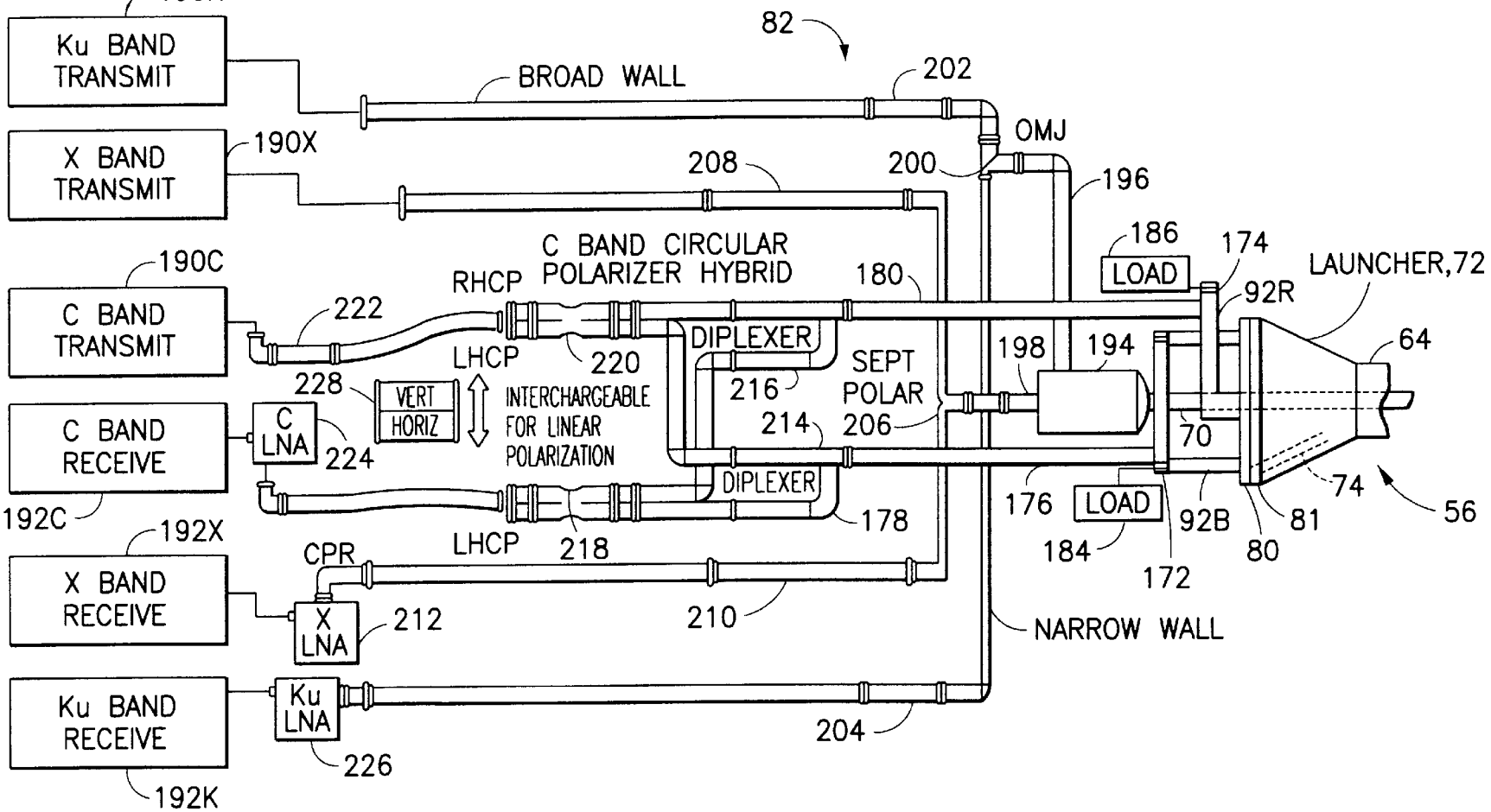
FIG. 16 is a schematic view of the waveguide system providing RF support for operation of the feed.

As best seen in FIG. 15, the waveguides 92T and 92B are combined at a magic Tee 172, and the waveguides 92R and 92L are combined at a magic Tee 174. The combined signals outputted by the magic Tee 172 appear on waveguide 176 directed to a diplexer 178 (FIG. 16), and the signals combined by the magic Tee 174 are outputted via waveguide 180 to a diplexer 182 (FIG. 16). Each of the magic Tees 172 and 174 have a fourth branch, namely a load 184 in the magic Tee 172, and a load 186 in the magic Tee 174. It is to be understood that the use of magic Tee's in the preferred embodiment for the invention is by way of example only, and that some other form of microwave device may be employed to provide the same function.

In operation, the outer feed waveguide 66 operates as a coaxial line while the inner waveguide of the tube 70 operates as a circular waveguide and is subject to a lower cut-off frequency. In the situation wherein the feed 56 is to operate, namely, wherein the frequency band of the X band signals is contiguous to the frequency band of the C band signals, it is desirable to inhibit entry of the C band signals within the tube 70. It is noted that any entry of the C band signals within the waveguide 70 will result in a reflection of some of the energy from the tube 70 back to the radiating aperture 188 of the feed 56. Thus, there is a lack of phase continuity between the C band signal radiated directly from the outer waveguide 66 and the reflected C band signal emanating from the tube 70. Such lack of phase continuity produces a change in the configuration of the beam directivity pattern. Generally, such change is objectionable and, accordingly, the invention provides for measures to inhibit the entry of the C band radiation into the interior of the tube 70 and, furthermore, to inhibit reflection of any C band radiation which has entered the tube 70. For this purpose, it is useful to reduce the diameter of the tube 70 below the cut-off frequency of the C band radiation, This would permit the X band radiation, which has a shorter wavelength, to propagate within the tube 70. However, a problem arises in that it is desirable to employ the feed 56 with both linearly polarized and circularly polarized X band radiation. It has been found that a circular waveguide operating near the cut-off frequency introduces an elliptical polarization to an initially circularly polarized wave. Accordingly, it becomes necessary to increase the diameter of the tube 70 approximately 10–15 percent above the minimum diameter required for the X band radiation. As a result, there is some entry of the C band radiation into the front end of the tube 70.

To minimize the effect of such entry of C band radiation into the front end of the tube 70, the front end of the tube 70 has been narrowed by the aforementioned neck 128. This does not have any significant effect on the circular polarization of the X band signal because the length of the neck 128 is relatively short in terms of waveguide wavelength. The narrowed diameter of the neck 128 inhibits entry of the C band radiation while the flared transition 136 facilitates egress of the X band and Ku band radiation.

The rod 144 is transparent to all three bands of radiation. Its dielectric constant is approximately double that of the air medium within the tube 70. As a result, there is a shortening of the wavelength of radiation propagating through the rod 144. This is useful in enlarging the effective radiating aperture, in terms of wavelength, of the X and the C band radiations for improved directivity of the radiation pattern. Further improvement is attained by the forward cavity 154. The tapering of the rear cavity 146 is effective to inhibit forward propagation of reflections of such C band radiation which has entered into the tube 70. Thus, the rod 144, in this respect, is effective to improve also the directivity pattern of the C band radiation.

FIG. 16 shows details of the waveguide construction in the waveguide system 82, indicated diagrammatically also in FIG. 3. The waveguide system 82 provides signal processing functions in the sense of combining and separating transmitted and received signals, as well as providing for a filtering of the signals. In addition, the waveguide system 82 provides the important function of establishing the desired polarizations for signals inputted to the launch waveguides 74 and the feed tube 70. FIG. 16 shows the waveguides 176, 180, and the feed tube 70 shown previously in FIG. 154. The magic Tee's 172 and 174 are connected by the plates 80 and 81 to the launcher 72. It is noted also that FIG. 16 has been simplified by deletion of the piston 90. The piston 90 is an optional part of the feed 56 and plays no significant role in terms of the electromagnetic propagation of signals from the waveguide system 82 to the launcher 72. Accordingly, to facilitate the description, the mounting plate 80 is shown in FIG. 16 as being connected directly to the mounting plate 81 which connects with the launcher 72.

The transmitters 190 of FIG. 3 are shown in greater detail in FIG. 16 as transmitters 190K, 190X and 190C corresponding to the Ku, the X and the C band radiations. Similarly, the receivers 192 of FIG. 3 are shown in greater detail in FIG. 16 which shows the receivers 192C, 192X, and 192K. The Ku and the X band signals are coupled from the feed tube 70 via a switch 194 which couples signals of the feed tube 70 alternately to a waveguide 196 or to a waveguide 198. The waveguide 196 is coupled via an orthomode junction (OMJ) 200 and a filter 202 to the Ku band transmitter 190K. The waveguide 196 is coupled via the OMJ 200 and a filter 204 to the Ku band receiver 192K. The waveguide 198 is coupled via a septum polarizer 206 and a filter 208 to the X band transmitter 190X. The waveguide 198 is coupled via the polarizer 206 and a filter 210 and a low noise amplifier (LNA) 212 to the X band receiver 192X.

The filter 202 is a band reject filter, the filter 208 is a band pass filter, the filter 210 is a band pass filter and the filter 204 is a band reject filter. The signals in the waveguides 176 and 180 are coupled via diplexers 214 and 216 and hybrid couplers 218 and 220 to the C band transmitter 190C and the C band receiver 192C. Each of the hybrid couplers 218 and 220 introduces a 90° phase shift between transmitted signals exiting the coupler to respective ones of the diplexers 214 and 216. Additionally, a bandpass filter 222 interconnects the hybrid coupler 220 with the transmitter 190C, and a low noise amplifier 224 couples the hybrid coupler 218 to the receiver 192C. Also, a low-noise amplifier 226 connects the filter 204 to the Ku band receiver 192K.

By virtue of the filters 202, 208, 210, and 204, and the OMJ 200 and polarizer 206, the signals in the waveguides 196 and 198 are separated as to frequency such that the waveguides 196 carries Ku band signals and the waveguide 198 carries X band signals. As shown in FIG. 16, the port of the OMJ 200 connecting with the filter 202 is depicted as a broad wall while the port of the OMJ 200 connecting with the filter 204 is portrayed as a narrow wall. This portrayal is intended to indicate the cross-polarization of linear TE waves coupled between the transmitter 190K and the OMJ 200 as compared to signals coupled between the receiver 192K and the OMJ 200. The OMJ 200 is able to couple signals of differing polarizations to the waveguide 196, thereby to enable signals transmitted and received via the inner feed waveguide of the tube 70 to have differing polarizations. The X band transmitted signals and the X band received signals are split at the polarizer 206 and are separated by the bandpass filters 208 and 210. In the case of the Ku band signals, there is one transmission band and one reception band and, accordingly, it suffices to use the band reject filters 202 and 204 to separate these signals. The polarizations of the signals in the waveguides 196 and 198 are retained by the switch 194 so as to be transmitted (or received) via the feed tube 70.

The diplexers 214 and 216 include filters (not shown) for separation of the transmit bands from the receive bands of the C band signals. The C band transmitter outputs a TE mode to the hybrid coupler 220. The hybrid coupler 220, via the diplexers 214 and 216, applies the transmit signal to each of the waveguides 176 and 180 for energization of opposed pairs of the launch waveguides 74. Since the two opposed sets of the launch waveguides 74 are positioned at space quadrature within the launcher 72, the transmitted C band signals may be either linearly polarized or circularly polarized depending on the phasing of the TE waves in the two pairs of the launch waveguides 74. Use of the hybrid coupler 220 introduces a 90° phase shift between the two signals resulting in a circularly polarized wave emitted by the feed 56. However, if desired, the hybrid coupler 220 may be replaced with a power splitter (combiner) 228 which enables transmission of the two branches of the signal with the same phase to radiate linearly polarized radiation. Similar comments apply to the reception of signals via the hybrid cover 218 such that the hybrid cover 218 enables reception of circularly polarized signals which are converted to a linear polarized TE signal. the linearly polarized signal is applied to the low noise amplifier 224, the amplifier 224 amplifying the signal for further processing at the receiver 192C. In the event that linear polarization is to be received, the hybrid coupler 218 is replaced with the power splitter (combiner) 228.

Figure 17:
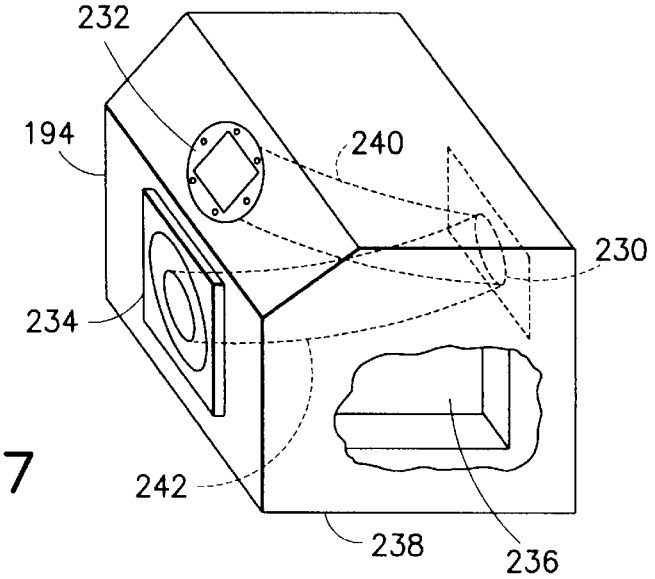
FIG. 17 is a stylized view of a switch of FIG. 16.

FIG. 17 shows details in the construction of the switch 194. A common port 230 connects with the feed tube 70 (FIG. 16). Opposite the common port 230 are two switched ports 232 and 234. A block 236 is mounted for sliding within a housing 238 of the switch 194, and contains passages 240 and 242 which can be placed between either one of the switched ports 232 and 234 and the common port 230. The passages 240 and 242 are arranged in a side-by-side format so that one position of the block 236 places one of the switched ports in communication with the common port while, in a second position of the block 236, the other of the switched ports is placed in communication with the common port.

With reference again to FIG. 11, it is noted that the radiating aperture of the feed tube 70 comprises the aforementioned neck 128 with the outer corrugation in the form of the deep reentrant cavity 130 and including also the dielectric plug 144. Typically, the rod (or plug) 144 is constructed of Teflon. A similar dielectric material, or Nylon, by way of further example is employed in construction of the sleeve 162, the ring 166, and the screws 168 which secure the window 164 to the front end of the shroud 62. As has been noted hereinabove, the rod 144, vy virtue of its dielectric constant is operative to attain, in cooperation with the shroud 126, a desired beneficial radiation directivity pattern. The neck 128 with its exterior corrugation composed of the reentrant cavity 130 enclosed between the two walls 132 and 134 also effect the impedance and modes presented to the radiating aperture of the feed tube. However, it should be noted that this construction of the radiating aperture of the feed tube 70 is useful in reducing moding and side lobes even in the absence of the horn 68 and the shroud 62. In other words, the construction of the inner feed waveguide and its front-end radiating structure is useful as a stand-alone device separate from the rest of the feed 56, and is operative at both the X and the Ku frequency bands.

With respect to dimensions of the neck 128, the thickness of the outer wall 134 is 0.05 inches in the preferred embodiment, it being understood that the dimensions of the neck 128 apply to the preferred embodiment of the invention and may be altered in the case of the transmission of signals at the other frequencies. Similarly, the inner wall 132 has a thickness of 0.05 inch. The width of the cavity 130, as measured between the walls 132 and 134 is 0.06 inch. The lengths of the walls 132 and 134 are 0.8 inch and 0.45 inch, respectively. The length of the neck 128 from the beginning of the transition 136 until the outer end of the inner wall 132 is 1.55 inch. The inside diameter of the neck is 0.85 inch. The inside diameter of the feed tube 70 at the beginning of the transition 136 is 1.07 inch.

With respect to the construction of the rod 144, the entrance angle of the cavity 146, as noted hereinabove, is equal to 32 degrees, and the diameter of the rod 144 is 0.848 inch. The overall length of the rod 144, prior to formation of the forward cavity 154, and prior to the tapering of the front edge of the cavity 154, is 2.823 inch. This dimension is reduced upon tapering the front edge to 25° from the horizontal and upon introduction of the forward cavity 154. The depth of the chamfer at the cavity floor 156 is 0.15 inch. The deepest point of the chamfer in the floor 156 is located at a depth of 0.65 inch. The taper at the front end of the cavity 154 has a depth of 0.15 inches, and extends from an outer diameter of ⅝ inch to the diameter of the cavity 154 which is 9/32 inch.

The lip 142 of the shallow reentrant cavity 126 of the shroud 62 has a depth of 0.13 inches, and is set forward of the end of the outer neck wall 134 by 0.9 inch. The length of the outer feed waveguide 66 is 10.1 inches. The length of the star-ridge assembly 106 as measured along the axis 100, is 3 inches. The axial length of the launcher 72 is 7 inches.

The foregoing construction of the invention succeeds in providing transmission over two contiguous octave bands including C, X and Ku bands from a single feed and having a structure suitable for use in either a mobile or stationary ground terminal in a satellite communication system.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A feed system for an antenna, the feed system comprising:

an inner electrically conducting tube and an outer electrically conducting tube, a space within the inner tube constituting an inner feed waveguide, and a space between the inner tube and the outer tube constituting an outer feed waveguide;

means for applying a higher frequency radiation to the inner feed waveguide, and a launcher for launching a wave of lower frequency radiation in the outer feed waveguide;

wherein said feed waveguides have coaxial radiating apertures for radiation of signals at the higher and the lower frequencies from a common phase center; and said launcher comprises a set of ridged launch waveguides merging with said outer feed waveguide, there being a tapering of ridges of said launch waveguides from a maximum value distant from said outer feed waveguide to a minimum value within a portion of said outer feed waveguide adjacent said launcher.

2. A system according to claim 1 wherein each of said launch waveguides is inclined relative to a central axis of said feed system, each of said launch waveguides has an arcuate rectangular cross sectional shape and comprises an outer arcuate broad wall and an inner arcuate broad wall located between said outer broad wall and said central axis, and each of said launch waveguides has a double ridged configuration with an outer ridge on said outer broad wall and an inner ridge on said inner broad wall.

3. A system according to claim 2 wherein, in each of said launch waveguides, said tapering includes a reduction in height of said outer ridge and an enlargement of height of said inner ridge with progression toward said outer feed waveguide.

4. A system according to claim 3 wherein, in said tapering, the height of said outer ridge is reduced to zero.

5. A system according to claim 3 wherein said tapering extends into said outer feed waveguide and includes a reduction in height of each of said inner ridges to provide a set of tapered ridges extending into said outer feed waveguide.

6. A system according to claim 5 wherein said launch waveguides are distributed uniformly about said central axis, and said set of tapered ridges which extend into said outer feed waveguide has the configuration of a star.

7. A system according to claim 6 wherein, in said tapering, the heights of said inner ridges of said star are reduced to zero.

8. A system according to claim 5 wherein there are four identical ones of said launch waveguides providing a generally conical envelope to said launcher, said four identical launch waveguides constituting two opposed pairs of said launch waveguides, said system further comprising first signal means for energizing a first of said waveguide pairs with first cophasal signals and a second signal means for energizing a second of said waveguide pairs with second cophasal signals, said first and said second cophasal signals inducing first and second traveling waves in said outer feed waveguide.

9. A system according to claim 8 wherein, in each of said launch waveguides, said broad walls are normal to a central longitudinal plane of said conical envelope, and said ridges lie in said central longitudinal plane.

10. A system according to claim 9 wherein, in each of said launch waveguides there are opposed sidewalls which join said broad walls, each of said sidewalls extends in a radial direction from said central axis of said feed assembly.

11. A system according to claim 10 wherein said lower frequency radiation occupies an octave of spectral space and is contiguous a spectral space of said higher frequency radiation, said ridges perform a function of mode locking of said lower frequency radiation, said feed system further comprising a set of rings within said outer feed waveguide for mode matching the signals of said lower frequency radiation to the radiating aperture of said outer feed waveguide.

* * * * *